US012023732B2

(12) United States Patent
Yong et al.

(10) Patent No.: US 12,023,732 B2
(45) Date of Patent: Jul. 2, 2024

(54) IRON-BASED MIXED POWDER AND METHOD FOR MANUFACTURING THE SAME

(71) Applicants: Hyundai Motor Company, Seoul (KR); Kia Corporation, Seoul (KR)

(72) Inventors: Wang Hyun Yong, Hwaseong-si (KR); Hyung Jin Jeon, Anyang-si (KR); Choong Kwon Park, Dangjin-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/813,418

(22) Filed: Jul. 19, 2022

(65) Prior Publication Data

US 2023/0128986 A1 Apr. 27, 2023

(30) Foreign Application Priority Data

Oct. 25, 2021 (KR) ..... 10-2021-0142868

(51) Int. Cl.

| | |
|---|---|
| ***B22F 1/102*** | (2022.01) |
| ***B22F 1/105*** | (2022.01) |
| ***B22F 1/12*** | (2022.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/52*** | (2006.01) |

(52) U.S. Cl.

CPC ..... *B22F 1/102* (2022.01); *B22F 1/105* (2022.01); *B22F 1/12* (2022.01); *C22C 38/002* (2013.01); *C22C 38/02* (2013.01); *C22C 38/04* (2013.01); *C22C 38/42* (2013.01); *C22C 38/44* (2013.01); *C22C 38/52* (2013.01); *B22F 2301/35* (2013.01); *B22F 2302/253* (2013.01); *B22F 2302/256* (2013.01); *B22F 2302/45* (2013.01)

(58) Field of Classification Search

None

See application file for complete search history.

(56) References Cited

U.S. PATENT DOCUMENTS

| | | | | |
|---|---|---|---|---|
| 5,256,185 | A | 10/1993 | Semel | |
| 5,368,630 | A | 11/1994 | Luk | |
| 2015/0314372 | A1 | 11/2015 | Ono et al. | |
| 2021/0197258 | A1* | 7/2021 | Oya | B22F 1/103 |

FOREIGN PATENT DOCUMENTS

| | | | |
|---|---|---|---|
| JP | H06145701 | A | 5/1994 |
| JP | 5272650 | B2 | 8/2013 |
| JP | 5439926 | B2 | 3/2014 |
| JP | 6436128 | B2 | 12/2018 |
| JP | 6760504 | B2 | 12/2019 |
| KR | 101202371 | B1 | 11/2012 |

OTHER PUBLICATIONS

JIP Reduced Iron Powders Atomized Iron and Steel Powders, JFE Steel Corporation, 2004, www.jfe-steel.co.jp/en/products/ironpowders/catalog/j1e-001.pdf. (Year: 2004).*

* cited by examiner

*Primary Examiner* — Anthony M Liang

(74) *Attorney, Agent, or Firm* — MCDONNELL BOEHNEN HULBERT & BERGHOFF LLP

(57) ABSTRACT

The present disclosure relates to an iron-based mixed powder having excellent uniformity, fluidity and moldability by applying polyamide as a binder, and a method for manufacturing the same. The iron-based mixed powder according to an embodiment of the present disclosure is composed of a mixture of a raw material of mixed powder in which iron-based powder and additive powder are mixed, and polyamide as a binder, wherein 0.03 to 1.50 parts by weight of the binder is mixed based on 100 parts by weight of the raw material of the mixed powder.

5 Claims, 3 Drawing Sheets

FIG. 1

| Specimen | | Binder (parts by weight) | Lubricant (parts by weight) | degree of bound graphite (%) | mold density ($g/cm^3$) | apparent density ($g/cm^3$) | fluidity (sec/50g) |
|---|---|---|---|---|---|---|---|
| No.1 | comparative example | – | 0.50 | 47 | 7.08 | 3.00 | NF |
| No.2 | comparative example | 0.02 | 0.50 | 54 | 7.08 | 3.01 | NF |
| No.3 | Example | 0.03 | 0.50 | 75 | 7.14 | 3.13 | 32 |
| No.4 | Example | 0.05 | 0.50 | 82 | 7.15 | 3.18 | 31 |
| No.5 | Example | 0.10 | 0.50 | 95 | 7.18 | 3.25 | 30 |
| No.6 | Example | 0.15 | 0.50 | 96 | 7.18 | 3.26 | 29 |
| No.7 | Example | 0.30 | 0.50 | 98 | 7.18 | 3.27 | 29 |
| No.8 | Example | 0.40 | 0.50 | 99 | 7.18 | 3.27 | 29 |
| No.9 | Example | 0.50 | – | 99 | 7.20 | 3.30 | 27 |
| No.10 | Example | 0.60 | – | 100 | 7.20 | 3.30 | 27 |
| No.11 | Example | 0.80 | – | 100 | 7.19 | 3.30 | 27 |
| No.12 | Example | 1.00 | – | 100 | 7.15 | 3.30 | 27 |
| No.13 | Example | 1.40 | – | 100 | 7.08 | 3.29 | 28 |
| No.14 | Example | 1.50 | – | 100 | 7.00 | 3.29 | 28 |

FIG. 2

| Specimen | | concentration of binder (parts by weight) | apparent density ($g/cm^3$) | fluidity (sec/50g) | agglomerate | drying time (min) |
|---|---|---|---|---|---|---|
| No.15 | Example | 5 | 3.30 | 27 | – | 320 |
| No.16 | Example | 10 | 3.30 | 27 | – | 160 |
| No.17 | Example | 30 | 3.30 | 27 | – | 50 |
| No.18 | Example | 40 | 3.29 | 28 | – | 35 |
| No.19 | Example | 50 | 3.27 | 29 | O | 25 |

FIG. 3

| Specimen | | manufacturing process | Binder (parts by weight) | | Lubricant (parts by weight) | degree of bound graphite (%) | apparent density (g/cm$^3$) | fluidity (sec/50g) | mold density (g/cm$^3$) | ejection force (MPa) |
|---|---|---|---|---|---|---|---|---|---|---|
| | | | content | type | | | | | | |
| No.20 | Example | liquid binder mixing | 0.8 | Polyamide | – | 100 | 3.30 | 27 | 7.19 | 12.8 |
| No.21 | Example | | 0.2 | Polyamide | 0.5 | 98 | 3.27 | 29 | 7.18 | 11.3 |
| No.22 | comparative example | | 0.2 | PVP | 0.5 | 98 | 3.28 | 32 | 6.97 | 22.6 |
| No.23 | comparative example | | 0.2 | Phenolic resin | 0.5 | 98 | 3.29 | 31 | 6.99 | 24.1 |
| No.24 | comparative example | | 0.2 | Cellulose ester | 0.5 | 98 | 3.35 | 26 | 6.98 | 22.7 |
| No.25 | comparative example | | 0.2 | SBR | 0.5 | 98 | 3.32 | 30 | 7.00 | 23.2 |
| No.26 | comparative example | | 0.2 | Epoxy resin | 0.5 | 98 | 3.30 | 32 | 6.98 | 22.3 |
| No.27 | comparative example | solid binder mixing | 0.4 | EBS | 0.5 | 97 | 3.23 | NF* | 7.04 | 13.4 |
| No.28 | comparative example | | 0.8 | | – | 100 | 3.30 | NF | 7.10 | 17.9 |
| No.29 | comparative example | | 0.4 | Paraffin | 0.5 | 98 | 3.26 | NF | 7.03 | 14.5 |

IRON-BASED MIXED POWDER AND METHOD FOR MANUFACTURING THE SAME

CROSS REFERENCE TO RELATED APPLICATIONS

The present application claims priority to Korean Patent Application No. 10-2021-0142868, filed Oct. 25, 2021, the entire contents of which is incorporated herein for all purposes by this reference.

TECHNICAL FIELD

The present disclosure relates to an iron-based mixed powder and a method for manufacturing the same, and more particularly, to an iron-based mixed powder having excellent uniformity, fluidity and formability by using polyamide as a binder, and a method for manufacturing the same.

BACKGROUND

Powder metallurgy technology is widely used to manufacture various mechanical parts, particularly engines, transmissions, etc. due to the advantage of significantly reducing manufacturing costs. Mixed powder for powder metallurgy is generally prepared by mixing iron-based powder as a main component with various additives such as graphite, nickel, copper, iron phosphide, lubricant, and the like. The mixed powder prepared in this way has a disadvantage of generating segregation and dust in the process of transporting or handling the powder because several components are simply mixed.

The segregation is caused by the differences in flow and fall properties due to different sizes, shapes, and specific gravity of the components of the mixed powder. Therefore, the segregation of the mixed powder mainly occurs in the process of using the powder, that is, filling the hopper with the powder, moving the powder through a supply pipe, or filling the mold with the powder. In particular, the segregation caused by small but low specific gravity components, such as graphite and lubricants, is the most severe.

The segregation of the mixed powder causes non-uniformity of components or density in parts, which may cause non-uniformity of physical properties of parts or, in severe cases, may cause defects (cracks, bubbles, etc.) in parts. In particular, uniformity issues become more important in the case of complex shapes or large parts.

If a mold has a complicated shape, there may be a difference in the filling of raw material powder in certain parts such as narrow and deep grooves, which leads to an increase in the partial density deviation of a molded product. In addition, if a product has a large area, the segregation phenomenon is further amplified because the moving distance of the powder is long.

This segregation occurs when the powder is filled in the mold and is mainly related to the flow properties of the powder. If the fluidity of powder is not good, the powder filling properties for narrow and deep grooves are not good. Conversely, even if the fluidity of powder is too good, side effects due to migration segregation may occur.

Such problems can be solved by adding a small amount of binder during the mixing process. The binder serves to bind additive particles, particularly fine particles of 25 μm or less, to the surface of the matrix powder particles having a relatively large particle size. The binding of the small particles to the surface of large particles by using the binder can effectively reduce problems such as segregation and dust generation.

On the other hand, the addition of binder significantly changes other properties of the mixed powder, such as apparent density, fluidity, compressibility, and lubricity, in addition to the reduction in segregation and dust.

For example, the application of the binder generally reduces the volume of the mixed powder and makes the surface of cured particles smoother by binding the fine particles with poor fluidity and the particles with low specific gravity to the surface of large particles, thereby showing the effect of improving apparent density, fluidity, and compressibility.

The change in the properties of the powder mixture by the binder largely depends on the type of the binder material used. The most commonly reported binders include curable or thermoplastic resins such as cellulose ester, polyvinyl pyroledone (PVP), phenolic resin, epoxy resin, polyethylene, etc., and wax-based organic substances such as styrene butadiene rubber (SBR), ethylene bis stearamide (EBS), zinc stearate, paraffin, etc.

A binder mixing method is broadly classified into two types as follows, and a suitable method depends on the type of the organic material used.

First, a liquid binder mixing method is a manufacturing method in which an organic binder is dissolved in a solvent, dispersed in powder and bound, and then the solvent is dried. A solid binder mixing method is a manufacturing method in which a solid organic binder is heated and melted, then bound to the powder and cooled.

The liquid binder mixing method is advantageous for substances that are easily soluble in organic solvents, such as cellulose ester, and the solid binder mixing method is advantageous for binders that are easy to dissolve at temperatures below 200° C., such as ethylene bis stearamide.

On the other hand, although the use of the binder effectively reduces segregation and dust generation by binding small and light particles such as carbon or lubricant, side effects such as a decrease in compressibility or a decrease in lubricity may appear depending on the binder material used.

For example, in the case of cellulose ester, the binding effect is good and the fluidity of the mixture powder with the binder is excellent, but there is a disadvantage that the compressibility and the lubricity are significantly reduced. This is because cellulose ester has high binding strength and has a smooth, dry surface, which is good for preventing segregation and improving fluidity, but cellulose ester itself has high hardness and lack of lubricity, which reduces the compressibility and lubricity of the mixed powder. This phenomenon is common to most resin or rubber binders such as polyvinyl pryroledone, phenolic resin, epoxy resin, and SBR.

On the other hand, waxes such as EBS and zinc stearate have advantages in lubricity and compressibility as they are mainly used as lubricants. However, such materials are mixed by the solid binder mixing method and the binding strength is not relatively high, so a fairly large amount (0.2% or more, 1.0% or less in the mixed powder) should be used as the binder in order to obtain the desired degree of binding. In addition, since the lubricity of the wax used as the binder is significantly lower than that of the powder in the form of particles, the lubricating powder must be additionally added in order to secure the sufficient lubricity of the mixed powder. The additionally added lubricating powder occupies an additional space during molding, and as a result, it is also a cause of lowering the compressibility of the mixed powder.

In addition, the surface of the mixed powder particles coated with the wax binder has some viscosity, so the fluidity is not good. Thus, in order to overcome this, a large amount of fluidity improving additive is required.

The content described as the above background art is only for understanding the background of the present disclosure, and should not be taken as an acknowledgment that it corresponds to the prior art already known to those of ordinary skill in the art.

SUMMARY

The present disclosure provides an iron-based mixed powder having high degree of binding and excellent uniformity, fluidity and moldability by using a binder which has excellent binding strength and does not deteriorate the properties of the mixed powder, and a method for manufacturing the same.

The technical objects to be achieved by the present disclosure are not limited to the technical objects mentioned above, and it will be apparent that other technical objects not mentioned can be clearly understood by those of ordinary skill in the art from the description of the present disclosure.

An iron-based mixed powder according to an embodiment of the present disclosure is composed of a mixture of a raw material of mixed powder in which iron-based powder and additive powder are mixed, and polyamide as a binder. Here, 0.03 to 1.50 parts by weight of the binder is mixed based on 100 parts by weight of the raw material of the mixed powder.

Preferably, 0.10 to 1.00 parts by weight of the binder is mixed based on 100 parts by weight of the raw material of the mixed powder.

The binder is in a solid state at a room temperature, and is in a state of being dispersed and bound to a surface of the raw material of the mixed powder.

The iron-based powder includes at least one powder of water atomized iron powder, reduced iron powder, pre-alloyed iron-based powder, and diffusion-alloyed iron-based powder.

The iron-based powder is composed by including at least one of 10 wt % or less of Cr, 2.0 wt % or less of Mo, 10.0 wt % or less of Ni, 8.0 wt % or less of Co, 5.0 wt % or less of Cu, 2.0 wt % or less of Mn, 2.0 wt % or less of Si and 1.0 wt % or less of P, and a remainder consisting of Fe and other unavoidable impurity.

The additive powder is at least one of an alloy additive, a hard phase additive, a processability improving additive, and a fluidity improving additive. As the alloy additive, at least one of 3.0 wt % or less of C, 5.0 wt % or less of Cu, 2.0 wt % or less of Mo, 10.0 wt % or less of Ni, 2.0 wt % or less of Mn, and 1.0 wt % or less of P is mixed, as the hard phase additive, 10 wt % or less of ferro moly (FeMo) is mixed, as the processability improving additive, at least one of 1.0 wt % or less of MnS and 1.0 wt % or less of $CaF_2$ is mixed, as the fluidity improving additive, at least one of $SiO_2$, $TiO_2$, $Fe_3O_4$ and carbon black is mixed in an amount of 2.0 wt % or less.

A lubricant is additionally mixed with the raw material of the mixture powder.

As the lubricant, at least one of amide wax, fatty acid amide, and stearate is mixed in an amount of 2.0 wt % or less.

In addition, a method for manufacturing an iron-based mixed powder according to an embodiment of the present disclosure includes the steps of preparing a raw material of mixed powder by mixing iron-based powder and an additive powder; preparing a binder solution by dissolving polyamide serving as a binder in an organic solvent; binding the binder solution to a surface of the raw material of the mixture powder by mixing and stirring the raw material of the mixture powder and the binder solution; and drying for coagulating the polyamide by removing the solvent from the binder solution bound to the surface of the raw material of the mixed powder.

In the step of preparing the raw material of the mixed powder, the iron-based powder includes at least one powder of water atomized iron powder, reduced iron powder, pre-alloyed iron-based powder, and diffusion-alloyed iron-based powder, and the additive powder includes at least one of an alloy additive, a hard phase additive, a processability improving additive, and a fluidity improving additive.

In the step of preparing the raw material of the mixed powder, the iron-based powder is composed by containing at least one of 10 wt % or less of Cr, 2.0 wt % or less of Mo, 10.0 wt % or less of Ni, 8.0 wt % or less of Co, 5.0 wt % or less of Cu, 2.0 wt % or less of Mn, 2.0 wt % or less of Si and 1.0 wt % or less of P, and a remainder consisting of Fe and other unavoidable impurity, the alloy additive is at least one of 3.0 wt % or less of C, 5.0 wt % or less of Cu, 2.0 wt % or less of Mo, 10.0 wt % or less of Ni, 2.0 wt % or less of Mn, and 1.0 wt % or less of P, the hard phase additive is 10 wt % or less of ferro moly (FeMo), the processability improving additive is at least one of 1.0 wt % or less of MnS and 1.0 wt % or less of $CaF_2$, and the fluidity improving additive is at least one of $SiO_2$, $TiO_2$, $Fe_3O_4$ and carbon black in an amount of 2.0 wt % or less.

In the step of preparing the raw material of the mixed powder, a lubricant is additionally mixed with the raw material of the mixture powder.

In the step of preparing the raw material of the mixed powder, as the lubricant, at least one of amide wax, fatty acid amide, and stearate is mixed in an amount of 2.0 wt % or less.

In the step of preparing the binder solution, the binder solution is prepared by dissolving 5 to 50 parts by weight of the polyamide based on 100 parts by weight of the organic solvent.

In the step of preparing the binder solution, the binder solution is prepared by dissolving 10 to 40 parts by weight of the polyamide based on 100 parts by weight of the organic solvent.

In the step of preparing the binder solution, the organic solvent is toluene or isopropyl alcohol.

In the step of binding, the binder solution is mixed so that 0.03 to 1.50 parts by weight of the polyamide dissolved in the binder solution is mixed based on 100 parts by weight of the raw material of the mixture powder.

According to an embodiment of the present disclosure, it is possible to develop a new polyamide binder used for manufacturing the mixed powder for powder metallurgy and to secure a technology for manufacturing the binder-mixed powder having excellent quality and performance by using this binder.

In addition, since the iron-based mixed powder according to an embodiment of the present disclosure shows little segregation and dust of chemical components and has excellent compressibility, lubricity and fluidity, it is possible to manufacture powder metallurgy sintered parts having excellent quality and performance, and expect the effect of maintaining a comfortable environment of the manufacturing process.

BRIEF DESCRIPTION OF THE DRAWINGS

FIG. 1 is a table showing the results of an experiment to investigate the change in the properties of the iron-based mixed powder according to an amount of binder mixed.

FIG. 2 is a table showing the results of an experiment to investigate the change in the properties of the iron-based mixed powder according to the concentration of binder solution.

FIG. 3 is a table showing the results of an experiment to investigate the change in properties of the iron-based mixed powder according to the type and manufacturing method of binder.

DETAILED DESCRIPTION

Hereinafter, embodiments of the present disclosure will be described in more detail with reference to the accompanying drawings. However, the present disclosure is not limited to the embodiments disclosed below, but will be implemented in a variety of different forms, and the present embodiments are provided only to complete the present disclosure, and to fully inform those of ordinary skill in the scope of the present disclosure.

The iron-based mixed powder according to an embodiment of the present disclosure is composed of a mixture of raw material of mixed powder in which iron-based powder and additive powder are mixed, and polyamide as binder. In addition, lubricant may be further mixed with the raw material of the mixture powder.

The raw material of the mixed powder is a base material constituting the iron-based mixed powder, which is a material for sintered parts, and is made by mixing the additive powder with the iron-based powder.

In this case, the iron-based powder may include at least one powder of water atomized iron powder, reduced iron powder, pre-alloyed iron-based powder, and diffusion-alloyed iron-based powder.

In addition, the iron-based powder includes at least one of 10 wt % or less of Cr, 2.0 wt % or less of Mo, 10.0 wt % or less of Ni, 8.0 wt % or less of Co, 5.0 wt % or less of Cu, 2.0 wt % or less of Mn, 2.0 wt % or less of Si and 1.0 wt % or less of P, and the contents is adjusted assuming that the remainder consists of Fe and other unavoidable impurities.

For example, if the pre-alloyed iron-based powder is selected as the iron-based powder, the composition and content of the pre-alloyed iron powder is 10 wt % or less of Cr, 2.0 wt % or less of Mo, 10.0 wt % or less of Ni, 8.0 wt % or less of Co, 5.0 wt % or less of Cu, 2.0 wt % or less of Mn, 2.0 wt % or less of Si and 1.0 wt % or less of P, and the content is preferably adjusted assuming that the remainder consists of Fe and other unavoidable impurities.

In addition, if the diffusion-alloyed iron-based powder is selected as the iron-based powder, the composition and content is 8.0 wt % or less of Ni, 2.0 wt % or less of Mo, 2.0 wt % or less of Cu, and the content is preferably adjusted assuming that the remainder consists of Fe and other unavoidable impurities.

In addition, as the additive (including metallic and non-metallic components) powder, at least one of an alloy additive, a hard phase additive, a processability improving additive, and a fluidity improving additive is preferably selected and mixed.

Here, as the alloy additive, at least one of 3.0 wt % or less of C, 5.0 wt % or less of Cu, 2.0 wt % or less of Mo, 10.0 wt % or less of Ni, 2.0 wt % or less of Mn, and 1.0 wt % or less of P may be mixed.

As the hard phase additive, 10 wt % or less of ferro moly (FeMo) may be mixed.

As the processability improving additive, at least one of 1.0 wt % or less of MnS and 1.0 wt % or less of $CaF_2$ may be mixed.

As the fluidity improving additive, at least one of $SiO_2$, $TiO_2$, $Fe_3O_4$, and carbon black may be mixed in an amount of 2.0 wt % or less.

In addition, a single lubricant or a combination of several lubricants may be additionally mixed with the raw material of iron-based powder to improve the compressibility of the iron-based mixed powder and to facilitate ejection of the molded product.

Here, as the lubricant, at least one of amide wax, fatty acid amide, and stearate may be mixed in an amount of 2.0 wt % or less.

Meanwhile, in this embodiment, polyamide is used as the binder in order to improve the degree of additive powder bound to the surface of the iron-based powder forming the raw material of the mixture powder.

In particular, it is preferable that 0.03 to 1.50 parts by weight of the polyamide binder is mixed based on the weight of the raw material of the mixed powder, that is, 100 parts by weight of the raw material of the mixed powder. More preferably, 0.10 to 1.00 parts by weight of the polyamide binder are mixed based on 100 parts by weight of the raw material of the mixture powder.

If the polyamide binder is mixed in an amount of less than 0.03 parts by weight, the binding between the iron-based powder and the additive powder is not sufficient. If the polyamide binder is mixed in an amount of more than 1.50 parts by weight, the volume occupied by the binder may increase, thereby reducing the compressibility of the iron-based mixed powder during molding.

In particular, the appropriate amount of the binder to be mixed is preferably determined according to the amount of the additive powder to be mixed within the range of 0.03 to 1.50 parts by weight as suggested above. That is, the more carbon (C) is mixed as the alloy additive, that is, the greater the content of light and fine additive powder including graphite, the greater the amount of binder is mixed. Also, it is preferable that the smaller the content of the additive powder is, the smaller the amount of binder is mixed.

In addition, it is preferable that the amount of the binder to be mixed is determined depending on whether or not the lubricant is mixed.

If a separate lubricant is mixed after coagulating the binder, since the binder is used only for pure binding purposes, the preferred amount of the binder mixed is preferably 0.03 to 0.50 parts, more preferably 0.10 to 0.40 parts by weight, based on 100 parts by weight of the raw material of the mixed powder.

On the other hand, if a separate lubricant is not mixed, it is necessary to add an excess of polyamide which acts as a lubricant for the purpose of providing sufficient lubricity to the iron-based mixed powder in addition to the binding purpose. In this case, the preferred amount of the binder mixed is preferably 0.40 to 1.50 parts by weight, more preferably 0.50 to 1.00 parts by weight, based on 100 parts by weight of the raw material of the mixed powder.

On the other hand, polyamide used as the binder is in a solid state at a room temperature, and accordingly, in a state of being mixed with the iron-based mixed powder, the polyamide binder is in a state of being dispersed and bound to the surface of the raw material of the mixed powder. In particular, the polyamide binder serves to bind the additive powder while being attached to the surface of the iron-based powder forming the raw material of the mixture powder.

Next, according to an embodiment of the present disclosure, a method for manufacturing the iron-based mixed powder composed as described will be described.

In order to prepare the iron-based mixed powder according to an embodiment of the present disclosure, first, the iron-based powder and the additive powder are mixed to prepare a raw material of mixture powder. (A preparation step of a raw material of mixture powder)

Here, as described above, as the iron-based powder, at least one powder of water atomized iron powder, reduced iron powder, pre-alloyed iron-based powder, and diffusion-alloyed iron-based powder is used.

The additive powder includes at least one of an alloy additive, a hard phase additive, a processability improving additive, and a fluidity improving additive.

In addition, a lubricant may be additionally mixed with the raw material of the mixture powder.

When the raw material of the mixture powder is prepared in this way, a binder solution is prepared by dissolving polyamide serving as a binder in an organic solvent. (A preparation step of a binder solution)

In this embodiment, the binder solution is prepared by dissolving polyamide used as the binder in the organic solvent such as toluene or isopropyl alcohol. In this case, isopropyl alcohol, which has relatively low toxicity, may be preferably selected as the organic solvent.

Meanwhile, the binder solution is preferably prepared by dissolving 5 to 50 parts by weight of polyamide based on 100 parts by weight of the organic solvent. More preferably, the binder solution is prepared by dissolving 10 to 40 parts by weight of polyamide based on 100 parts by weight of the organic solvent.

As in the preparation step of the binder solution, the polyamide used as the binder is dissolved in the organic solvent to prepare the binder in a solution state, and the binder is mixed with the raw material of the mixture powder in the liquid binder mixing method. The reason is that, since the melting point of polyamide is as high as 264° C., the solid binder mixing method in which the binder is heated and melted and then bound is not suitable.

When the raw material of the mixed powder and the binder solution are prepared in this way, the raw material of the mixed powder and the binder solution are mixed and stirred to bind the binder solution to the surface of the raw material of the mixed powder. (A binding step). Thus, the binder solution is to be evenly dispersed while being mixed with the raw material of the mixed powder.

In this case, as a mixer for mixing the raw material of the mixture powder and the binder solution, various mixing devices such as a Nauta mixer, a double cone mixer, and a turbula mixer may be used. Although the mixing efficiency may be different for each type of mixer, it is preferable to use the Nauta mixer in this embodiment.

Meanwhile, in the binding step, it is preferable to mix the binder solution so that 0.03 to 1.50 parts by weight of polyamide dissolved in the binder solution is mixed based on 100 parts by weight of the raw material of the mixture powder.

In addition, in a general liquid binder mixing process, the binder is added by uniformly spraying the binder through a spray machine. The present embodiment can prepare the iron-based mixed powder having sufficiently uniform and excellent properties even if the binder solution is added in an easy and convenient way by pouring it into the mixer. Therefore, the method of mixing the binder solution with the raw material of the mixture powder is not limited to a special method, and various methods may be applied.

In this way, if the raw material of the mixed powder and the binder solution are uniformly mixed in the binding step and the binder solution is evenly dispersed on the surface of the raw material of the mixed powder, the solvent is removed from the binder solution dispersed and bound on the surface of the raw material of the mixed powder to coagulate polyamide. (A drying step)

After the binder solution is evenly dispersed on the surface of the raw material of the mixture powder through the binding step, the organic solvent of the binder solution is removed and the polyamide binder is coagulated through the drying step. Through these steps, the small and light particles of the additive powder are bound to the surfaces of the relatively large particles of the iron-based powder via the polyamide.

Hereinafter, the present disclosure will be described with Comparative Examples and Examples.

The following powders were used to prepare the iron-based mixed powders according to Comparative Examples and Examples.

First, as the iron-based powder, water atomized iron powder (HSPP-2, D50 75 μm, Max 250 μm or less, Hyundai Steel, Korea) was used.

As the additive powder, water atomized copper powder (D50 35 μm), graphite (D50 7 μm), calcium fluoride (D50 7 μm) were used, and the lubricant (Lube-M, D5020 μm, PMSol, Korea) was optionally used.

Polyamide was used as the binder, and the binder solution was prepared by dissolving polyamide in isopropyl alcohol, which was an organic solvent.

On the other hand, for the preparation of the iron-based mixed powder, first, the raw material of the mixture powder and the binder solution were prepared to have a target component composition, and then the raw material of the mixture powder was mixed for 15 minutes in a Nauta mixer to be sufficiently homogenized. Thus, when the mixing of the iron-based powder and the additive powder constituting the raw material of the mixed powder was completed, a predetermined amount of the binder solution was charged into the mixer in which the raw material of the mixed powder was mixed, and the binding step was performed for 10 minutes.

Therefore, when the raw material of the mixture powder and the binder solution were sufficiently mixed, the mixture was vacuum dried at a room temperature or about 60° C. or less through the drying step, and then discharged from the mixer.

On the other hand, the experimental method to be performed later was carried out in the following manner.

The fluidity and apparent density of the iron-based powder mixture were measured according to MPIF standards (MPIF standards 03, 04) using a Gustayson measuring instrument.

Then, the degree of bound graphite was measured according to Equation 1 below.

$$\text{degree of bound graphite} = \frac{C_{bound}}{C_{total}} \times 100 \qquad \text{[Equation 1]}$$

In Equation 1, $C_{total}$ means the total amount of graphite mixed in the iron-based mixed powder, and it is measured after the manufactured iron-based mixed powder is burned to remove organic materials such as binders and lubricants.

In addition, $C_{bound}$ means the graphite content bound to the particle surface of the iron-based powder, and it means the carbon content after removing the free carbon not bound by a certain amount of wind while dropping the prepared iron-based mixed powder from a certain height, and then burning the powder to remove organic materials including binders. All graphite content in this experiment was measured by a carbon analyzer (Leco, USA).

In addition, in the method of evaluating compressibility, the iron-based mixed powder was molded into a cylindrical specimen having an outer diameter of 40 mm, an inner diameter of 22 mm, and a height of 20 mm under a pressure of 600 MPa using a hydraulic press. Here, the compressibility of the iron-based mixed powder was relatively compared through the molding density. The density of the molded body was measured according to the MPIF standard 42 using the Archimedes principle.

The lubricity of the iron-based powder mixture was evaluated using a universal testing machine (MTS Model C45.105). After loading 10 g of iron-based powder mixture into a cylindrical mold with a diameter of 10 mm, a unidirectional compressive load is applied at a pressure of 600 MPa in the universal testing machine to compress and mold the iron-based powder mixture. After that, the molded body compacted in the mold was ejected in the opposite direction to the pressed direction, and the lubricity of the iron-based mixed powder was evaluated by the force used for ejection, that is, the ejection force. The lower the ejection force, the better the lubricity of the iron-based mixed powder.

Experiment 1: Evaluation of the Degree of Bound Graphite and Compressibility of the Iron-Based Powder Mixture According to an Amount of the Binder Mixed.

FIG. 1 is a table showing the results of an experiment to investigate the change in the properties of the iron-based mixed powder according to an amount of binder mixed.

In order to investigate the amount range of the polyamide binder mixed, the iron-based mixed powder was prepared so that the contents of the components were adjusted as shown in FIG. 1, and then the degree of bound graphite and the molding density were evaluated. In this embodiment, the binder solution was prepared by dissolving 30 parts by weight of polyamide based on 100 parts by weight of the organic solvent.

As illustrated in FIG. 1, when the amount of the binder mixed is 0.40 parts by weight or less based on 100 parts by weight of the raw material of the mixture powder, 0.50 wt % of the lubricant was separately added to compensate for insufficient lubricity. In addition, as the additive powder, 3.00 wt % of copper, 0.80 wt % of graphite and 0.50 wt % of $CaF_2$ were mixed.

As can be seen in FIG. 1, when the amount of the binder mixed exceeds 0.03 parts by weight, the degree of bound graphite increased rapidly to 70% or more. When the amount of the binder mixed is 0.10 parts by weight or more, the degree of bound graphite was close to 100%. When the amount of the binder mixed is 0.60 parts by weight or more, the degree of bound graphite of 100% was shown.

In addition, when the amount of the binder mixed exceeds 0.03 parts by weight, the molding density rapidly increases. This may be due to the fact that the volume of the iron-based mixed powder is reduced and the fluidity of the iron-based mixed powder is improved as light and small particles such as graphite are bound to the surface of the iron-based powder particles.

In particular, this can be confirmed by comparing the apparent density and fluidity of specimens No. 3 to No. 14 compared to specimens No. 1 and No. 2. When the amount range of the binder mixed is 0.10 to 0.80 parts by weight, the molding density shows a maximum value, and when the amount of the binder mixed is 1.50 parts by weight or more, the molding density decreases rapidly. It can be inferred that the sudden drop in molding density is due to the binder occupying too much space and preventing the compression of the mixed powder.

Experiment 2: Manufacturability of Iron-Based Mixed Powder and Evaluation of Powder Properties According to the Concentration of Binder Solution.

FIG. 2 is a table showing the results of an experiment to investigate the change in the properties of the iron-based mixed powder according to the concentration of binder solution.

In order to investigate the appropriate concentration of the binder, the iron-based mixed powder was prepared so that the content of each component was adjusted as shown in FIG. 2, and then the time for drying the powder and the properties of the iron-based mixed powder were evaluated. Here, in order to make the amount of the polyamide mixed with the iron-based mixed powder constant, the amount of the organic solvent was adjusted while the amount of the binder was fixed when the concentration of the binder solution was adjusted. In this case, the amount of the binder mixed was fixed to 0.8 parts by weight. As the additive powder, 3.00 wt % of copper, 0.80 wt % of graphite and 0.50 wt % of $CaF_2$ were mixed.

As can be seen in FIG. 2, when the concentration of polyamide in the binder solution is increased, there is no change in the properties of the iron-based mixed powder until the content of the polyamide is up to 30 parts by weight, but a slight decrease in the apparent density and a decrease in the flowability begin to appear when the content of the polyamide is from 40 parts by weight. In addition, when the content of the polyamide exceeds 50 parts by weight, such change was clearly seen.

In addition, when the concentration of the binder solution is 50 parts by weight or more, agglomerates are found in the iron-based mixed powder. It can be inferred that this is because the concentration of the binder solution is too high and there are the agglomerates of polyamide that have not been dissolved in the solution. Further, this is because, in the process of homogenizing the binder solution in the raw material of the mixture powder, the polyamide agglomerates are not uniformly dispersed in the raw material of the mixture powder.

In addition, when the concentration of the binder solution was too high, the viscosity of the binder solution was too high, so that polyamide was not evenly dispersed on the surface of the iron-based powder, and agglomerated with light and small particles such as graphite to form the agglomerates.

On the other hand, when the concentration of the binder solution was reduced, the drying time was increased accordingly because the amount of the solvent used was increased.

When the concentration of the binder solution is less than 5 parts by weight, it takes 5 hours or more to dry the powder, thereby greatly reducing the productivity of the iron-based mixed powder. Therefore, in order to maintain the concentration of the binder solution in an appropriate range, it can be confirmed that it is to prepare by dissolving preferably 5 to 50 parts by weight of polyamide, more preferably 10 to 40 parts by weight of polyamide, based on 100 parts by weight of the organic solvent.

Experiment 3: Evaluation of Properties of Iron-Based Mixed Powder According to the Type of Binder FIG. 3 is a table showing the results of an experiment to investigate the change in properties of the iron-based mixed powder according to the type and manufacturing method of binder.

In this experiment, the binder solution in which 30 parts by weight of polyamide was dissolved based on 100 parts by weight of the organic solvent was used.

In addition, for the specimens No. 22 to No. 26 to which the liquid binder mixing process was applied, the solvent was used and the concentration of the solvent was adjusted to be appropriate for the applied binder, and the same manufacturing method as in the example of the present disclosure was applied.

For the specimens No. 27 to No. 29 to which the solid binder mixing process was applied, the same manufacturing process as disclosed in Publication No. US2005480469A was applied. In addition, in order to compare the fluidity of the binder material, the fluidity of the specimens was measured without adding a fluidity improving agent.

As can be seen in FIG. 3, the specimens No. 20 and No. 21 correspond to representative examples of a case in which a separate lubricant is not used and a case in which a separate lubricant is used, respectively. In the case of No. 20, which does not use a separate lubricant, shows high degree of bound graphite and excellent apparent density and fluidity, compared to No. 21, which uses a lubricant. This means that No. 20 has advantages over No. 21 in terms of uniformity and handling.

On the other hand, No. 21, which uses a separate lubricant, has better lubricity than No. 20. The reason why the degree of bound graphite in No. 21 is slightly lower than that in No. 20 is that rather large particles with a particle size of 30 μm or more exist in the graphite powder used, and these particles are bound to the surface of the iron-based powder and may easily fall off by friction during the mixing process.

However, in the case of No. 21, since the content of the binder is as high as 0.8 parts by weight, the graphite particles are firmly bound to the surface of the iron-based powder, so that they do not fall off even by friction during mixing, indicating a high degree of bound graphite of 100%.

In the same principle, the large particles of 30 μm or more exist in the lubricant, and when the binder is 0.2 parts by weight, there is a high possibility that these particles are not bound to the surface of the iron-based powder particles but separate and exist separately. In FIG. 3, the degree of bound lubricant is not separately shown.

On the other hand, in the specimens No. 22 to No. 26, the degree of bound iron-based powder mixture was similar to that of the specimen No. 21, and the binding strength of the binder was similar to that of polyamide, but the molding density and ejection force were significantly decreased. This is considered to be because the hardness of the binder materials used in the corresponding specimens is relatively high, and the binder material itself has not lubricity so that the binder material coated on the surface of the lubricant particles deteriorates the function of the lubricant.

On the other hand, No. 20 and No. 21 show excellent molding density and ejection force, which means that the polyamide binder has quite low hardness and excellent lubricity. This is evidenced by the fact that, as shown in the specimens No. 5 to No. 8 of FIG. 1, there was no decrease in molding density as the content of polyamide increased from 0.1 parts by weight to 0.4 parts by weight, and the fact that the ejection force of No. 20 in FIG. 3 was good compared to the ejection force of No. 21.

On the other hand, according to the specimens No. 27 to No. 29, when the powder is manufactured with the solid binder mixing process by applying a wax binder such as EBS or paraffin, a larger amount of binder is required to secure the degree of bound graphite comparable to the degree of bound graphite in the specimens No. 20 to No. 26 to which the liquid binder mixing process is applied.

In addition, it was found that the iron-based mixed powder produced by this process did not flow through the hole of the Gustayson flow meter due to poor fluidity. This means that the wax binder coated on the particle surface of the iron-based powder is not smooth compared to the binder-coated surface of the specimens No. 20 to No. 26. Therefore, in order to secure the fluidity of the iron-based mixed powder, a fluidity improving agent must be added.

In addition, in the case of the binder mixture powder using the wax, a separate lubricant must be used as in No. 27 and No. 29 to secure lubricating properties equivalent to those of No. 20 and No. 21. When a separate lubricant is used, the ejection force is almost close to that of the specimens No. 20 and No. 21, but the compressibility is very low. It is confirmed that the ejection force of the specimen No. 28, in which no lubricant was used, was significantly lowered compared to the ejection force of No. 20.

Although the present disclosure has been described with reference to the accompanying drawings and the above-described preferred embodiments, the present disclosure is not limited thereto, but is defined by the following claims. Accordingly, those of ordinary skill in the art can variously change and modify the present disclosure within the scope without departing from the spirit of the claims to be described later.

What is claimed is:

1. An iron-based mixed powder, comprising:

a mixture of a raw material of mixed powder in which iron-based powder and additive powder are mixed, and polyamide as a binder, wherein 1.0 to 1.50 parts by weight of the binder is mixed based on 100 parts by weight of the raw material of the mixed powder.

2. The iron-based mixed powder according to claim 1, wherein the binder is in a solid state at a room temperature, and is in a state of being dispersed and bound to a surface of the raw material of the mixed powder.

3. The iron-based mixed powder according to claim 1, wherein the iron-based powder includes at least one powder of water atomized iron powder, reduced iron powder, pre-alloyed iron-based powder, and diffusion-alloyed iron-based powder.

4. The iron-based mixed powder according to claim 3, wherein the iron-based powder is composed by containing at least one of 10 wt % or less of Cr, 2.0 wt % or less of Mo, 10.0 wt % or less of Ni, 8.0 wt % or less of Co, 5.0 wt % or less of Cu, 2.0 wt % or less of Mn, 2.0 wt % or less of Si and 1.0 wt % or less of P, and a remainder comprising Fe and unavoidable impurities.

5. The iron-based mixed powder according to claim 1, wherein the additive powder is at least one of an alloy additive, a hard phase additive, a processability improving additive, and a fluidity improving additive, as the alloy additive, at least one of 3.0 wt % or less of C, 5.0 wt % or less of Cu, 2.0 wt % or less of Mo, 10.0 wt % or less of Ni, 2.0 wt % or less of Mn, and 1.0 wt % or less of P is mixed, as the hard phase additive, 10 wt % or less of ferro moly (FeMo) is mixed, as the processability improving additive, at least one of 1.0 wt % or less of MnS and 1.0 wt % or less of $CaF_2$ is mixed, as the fluidity improving additive, at least one of $SiO_2$, $TiO_2$, $Fe_3O_4$ and carbon black is mixed in an amount of 2.0 wt % or less.

* * * * *